US011107383B2

(12) United States Patent
Lee

(10) Patent No.: US 11,107,383 B2
(45) Date of Patent: Aug. 31, 2021

(54) DISPLAY DEVICE AND METHOD OF OPERATING A DISPLAY DEVICE

(71) Applicant: Samsung Display Co., Ltd., Yongin-Si (KR)

(72) Inventor: Chang-Soo Lee, Suwon-si (KR)

(73) Assignee: Samsung Display Co., Ltd.

( * ) Notice: Subject to any disclaimer, the term of this patent is extended or adjusted under 35 U.S.C. 154(b) by 15 days.

(21) Appl. No.: 16/846,419

(22) Filed: Apr. 13, 2020

(65) Prior Publication Data

US 2021/0104191 A1 Apr. 8, 2021

(30) Foreign Application Priority Data

Oct. 2, 2019 (KR) ..... 10-2019-0122175

(51) Int. Cl.
*G09G 3/20* (2006.01)

(52) U.S. Cl.
CPC ..... *G09G 3/20* (2013.01); *G09G 2310/0275* (2013.01); *G09G 2320/043* (2013.01)

(58) Field of Classification Search
CPC ..... G09G 3/3614; G09G 3/3655; G09G 2320/0219; G09G 2320/0257; G09G 2330/021; G09G 2340/0407; G09G 3/3677; G09G 2320/0214
See application file for complete search history.

(56) References Cited

U.S. PATENT DOCUMENTS

2016/0203753 A1 7/2016 Hwang et al.
2016/0372025 A1* 12/2016 Ahn ..... G09G 3/3655
2017/0323611 A1 11/2017 Jo et al.
2018/0268767 A1* 9/2018 Pyun ..... G02F 1/136213

FOREIGN PATENT DOCUMENTS

JP 5409329 B2 2/2014
KR 10-2017-0062611 A 6/2017

OTHER PUBLICATIONS

Soo Hwan Kim, Gyoung Bum Kim, Suk Ki Kim (Department of Electronics & Computer Engineering, Korea University, Seoul, Korea), and Richard I. McCartney (Displays Group, National Semiconductor, Santa Clara, California, USA), "P-16: A New Driving Method to Compensate for Row Line Signal Propagation Delays in an AMLCD", SID 04 digest, p. 280-283 , 4pages, ISSN/0004 280 • SID 04 Digest—0966X/04/3501-0280-$1.00+ .00 © 2004 SID.

* cited by examiner

*Primary Examiner* — Nelson M Rosario
(74) *Attorney, Agent, or Firm* — Innovation Counsel LLP

(57) ABSTRACT

A display device includes a display panel including a plurality of gate lines having a desired gate delay time, and a plurality of pixel rows, each of the plurality of pixel rows coupled to a corresponding one of the plurality of gate lines, a gate driver configured to sequentially provide a plurality of gate signals to the plurality of gate lines, a data driver configured to provide data signals to each of the plurality of pixel rows, and a controller configured to control the gate driver to sequentially output the plurality of gate signals and to control the data driver to output the data signals that are delayed by the desired gate delay time of the plurality of gate lines.

18 Claims, 12 Drawing Sheets

DISPLAY DEVICE AND METHOD OF OPERATING A DISPLAY DEVICE

CROSS-REFERENCE TO RELATED APPLICATION(S)

This application claims priority under 35 USC § 119 to Korean Patent Application No. 10-2019-0122175, filed on Oct. 2, 2019 in the Korean Intellectual Property Office (KIPO), the entire content of which is incorporated herein in its entirety by reference.

BACKGROUND

1. Field

Example embodiments of the present disclosure relate to a display device, and more particularly to a display device and a method of operating the display device.

2. Description of the Related Art

In a display device, data signals may be stored or charged in pixels coupled to each gate line during one horizontal (1H) time in which a gate signal is applied to the gate line, and the pixels may display an image based on the stored or charged data signals. In a case where the gate signal is delayed due to a load of the gate line, the data signals may not be sufficiently charged in the pixels during the one horizontal (1H) time that is allocated to the pixels coupled to the gate line, and thus an image quality of the display device may be deteriorated. In particular, as the one horizontal (1H) time decreases according to an increase of a resolution of the display device, the deterioration of the image quality may be intensified. Thus, a novel method to reduce a deterioration of the image quality is needed.

SUMMARY

Some example embodiments provide a display device capable of normally operating while having a high resolution.

Some example embodiments provide a method of operating the display device.

According to example embodiments, there is provided a display device including a display panel including a plurality of gate lines having a desired gate delay time, and a plurality of pixel rows, each of the plurality of pixel rows coupled to a corresponding one of the plurality of gate lines, a gate driver configured to sequentially provide a plurality of gate signals to the plurality of gate lines, a data driver configured to provide data signals to each of the plurality of pixel rows, and a controller configured to control the gate driver in order to sequentially output the plurality of gate signals, and to control the data driver to output the data signals that are delayed by the desired gate delay time of the plurality of gate lines.

In example embodiments, the controller may delay a data enable signal and output image data provided to the data driver by the desired gate delay time such that the data driver outputs the data signals that are delayed by the desired gate delay time.

In example embodiments, the desired gate delay time may correspond to one horizontal time.

In example embodiments, in response to a data enable signal and output image data that are delayed by the one horizontal time, the data driver may output the data signals for an (N−1)-th pixel row of the plurality of pixel rows while the gate driver outputs a first one of the plurality of gate signals for an N-th pixel row of the plurality of pixel rows, and may output the data signals for the N-th pixel row of the plurality of pixel rows while the gate driver outputs a second one of the plurality of gate signals for an (N+1)-th pixel row of the plurality of pixel rows, where N is an integer greater than 1.

In example embodiments, while the N-th pixel row receives the first one of the plurality of gate signals for the N-th pixel row, the N-th pixel row may further receive the data signals for the N-th pixel row.

In example embodiments, the plurality of gate lines may be designed to have the desired gate delay time corresponding to one horizontal time.

In example embodiments, the plurality of gate lines may be designed such that a width of each gate line decreases in a first case where an initial gate delay time of the gate line is shorter than one horizontal time and increases in a second case where the initial gate delay time of the gate line is longer than the one horizontal time.

In example embodiments, a number of the plurality of gate lines may correspond to a number of the plurality of pixel rows. The display panel may further include a plurality of data lines, and a number of the plurality of data lines may correspond to a number of a plurality of pixel columns of the display panel.

In example embodiments, a number of the plurality of gate lines may correspond to a number of the plurality of pixel rows. The display panel may further include a plurality of data lines, and a number of the plurality of data lines may correspond to twice a number of a plurality of pixel columns of the display panel.

In example embodiments, each pixel of the display panel may include a high sub-pixel coupled to a first data line of the plurality of data lines, and a low sub-pixel coupled to a second data line of the plurality of data lines.

In example embodiments, a number of the plurality of gate lines may correspond to a half number of the plurality of pixel rows. The display panel may further include a plurality of data lines, and a number of the plurality of data lines may correspond to a twice number of a plurality of pixel columns of the display panel.

In example embodiments, the display panel may have a quad ultra high definition (QUHD) resolution.

According to example embodiments, there is provided a method of operating a display device including a display panel, the display panel including a plurality of gate lines and a plurality of pixel rows, each of the plurality of pixel rows coupled to a corresponding one of the plurality of gate lines. In the method, the plurality of gate lines are designed to have a desired gate delay time, a plurality of gate signals is sequentially provided to the plurality of gate lines, data signals are delayed by the desired gate delay time of the plurality of gate lines, and the data signals that are delayed by the desired gate delay time are provided to each of the plurality of pixel rows.

In example embodiments, a data enable signal and output image data provided to a data driver may be delayed by the desired gate delay time such that the data driver outputs the data signals that are delayed by the desired gate delay time.

In example embodiments, the desired gate delay time may correspond to one horizontal time.

In example embodiments, to provide the data signals that are delayed by the desired gate delay time to each of the plurality of pixel rows, the data signals for an (N−1)-th pixel row of the plurality of pixel rows may be output while a first one of the plurality of gate signals for an N-th pixel row of the plurality of pixel rows is output, where N is an integer greater than 1, and the data signals for the N-th pixel row of the plurality of pixel rows may be output while a second one of the plurality of gate signals for an (N+1)-th pixel row of the plurality of pixel rows is output.

In example embodiments, while the N-th pixel row receives the first one of the plurality of gate signals for the N-th pixel row, the N-th pixel row may further receive the data signals for the N-th pixel row.

In example embodiments, the plurality of gate lines may be designed such that the plurality of gate lines has the desired gate delay time corresponding to one horizontal time.

In example embodiments, the plurality of gate lines may be designed such that a width of each gate line decreases in a first case where an initial gate delay time of the gate line is shorter than one horizontal time, and the plurality of gate lines may be designed such that the width of the gate line increases in a second case where the initial gate delay time of the gate line is longer than the one horizontal time.

In example embodiments, a number of the plurality of gate lines may correspond to a number of the plurality of pixel rows. The display panel may further include a plurality of data lines, and a number of the plurality of data lines may correspond to a number of a plurality of pixel columns of the display panel.

As described above, in a display device and a method of operating a display device according to example embodiments, a plurality of gate lines may be designed to have a desired (or predetermined) gate delay time, and a data driver may delay data signals by the desired (or predetermined) gate delay time of the plurality of gate lines to output the delayed data signals. Accordingly, even if the display device has a high resolution, the display device may operate normally.

BRIEF DESCRIPTION OF THE DRAWINGS

Illustrative, non-limiting example embodiments will be more clearly understood from the following detailed description in conjunction with the accompanying drawings.

DETAILED DESCRIPTION OF THE EMBODIMENTS

Hereinafter, embodiments of the present disclosure will be explained in detail with reference to the accompanying drawings.

Figure 1:
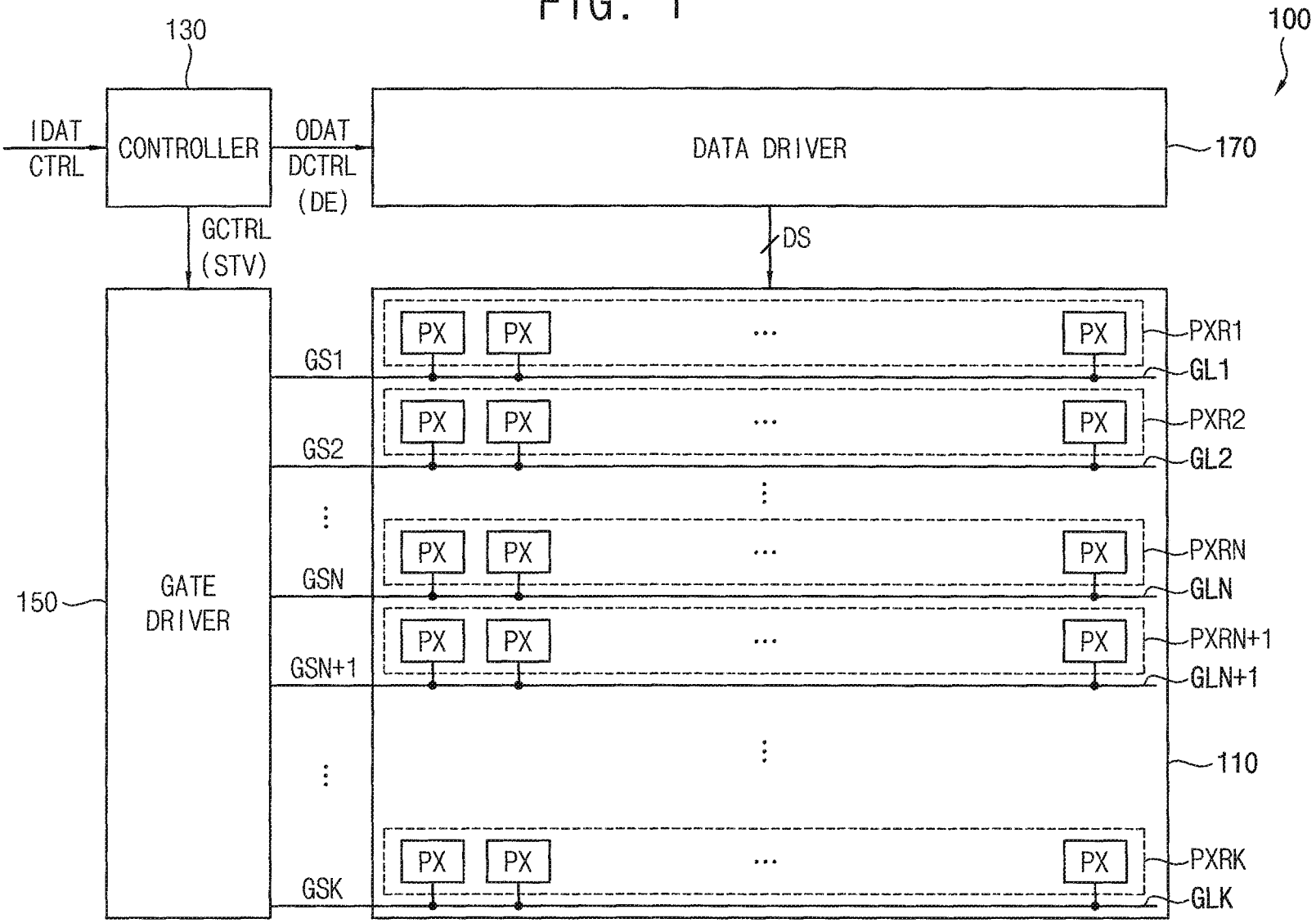
FIG. 1 is a block diagram illustrating a display device according to example embodiments.
Figure 2:
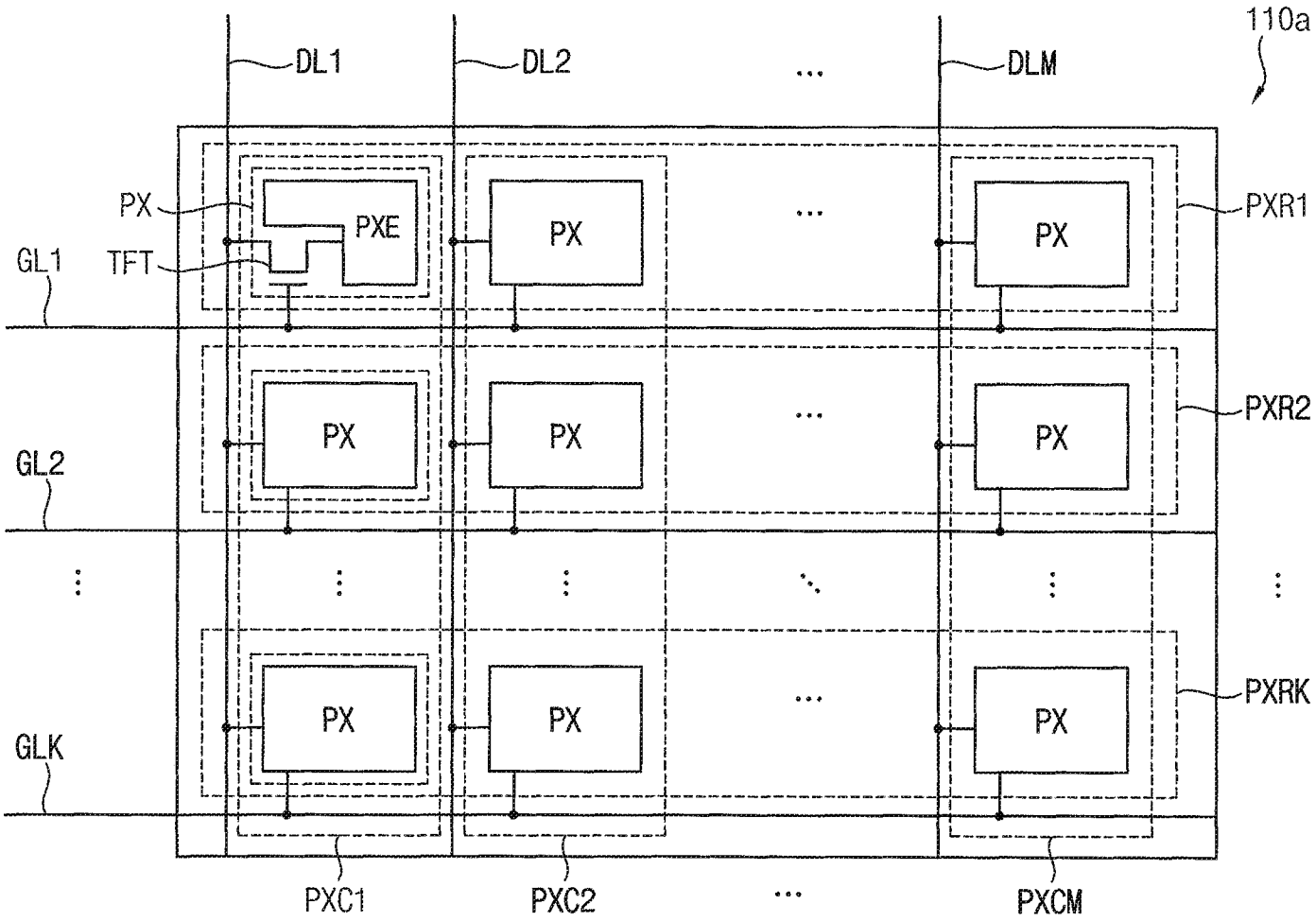
FIG. 2 is a diagram illustrating an example of a display panel included in a display device according to example embodiments.
Figure 3:
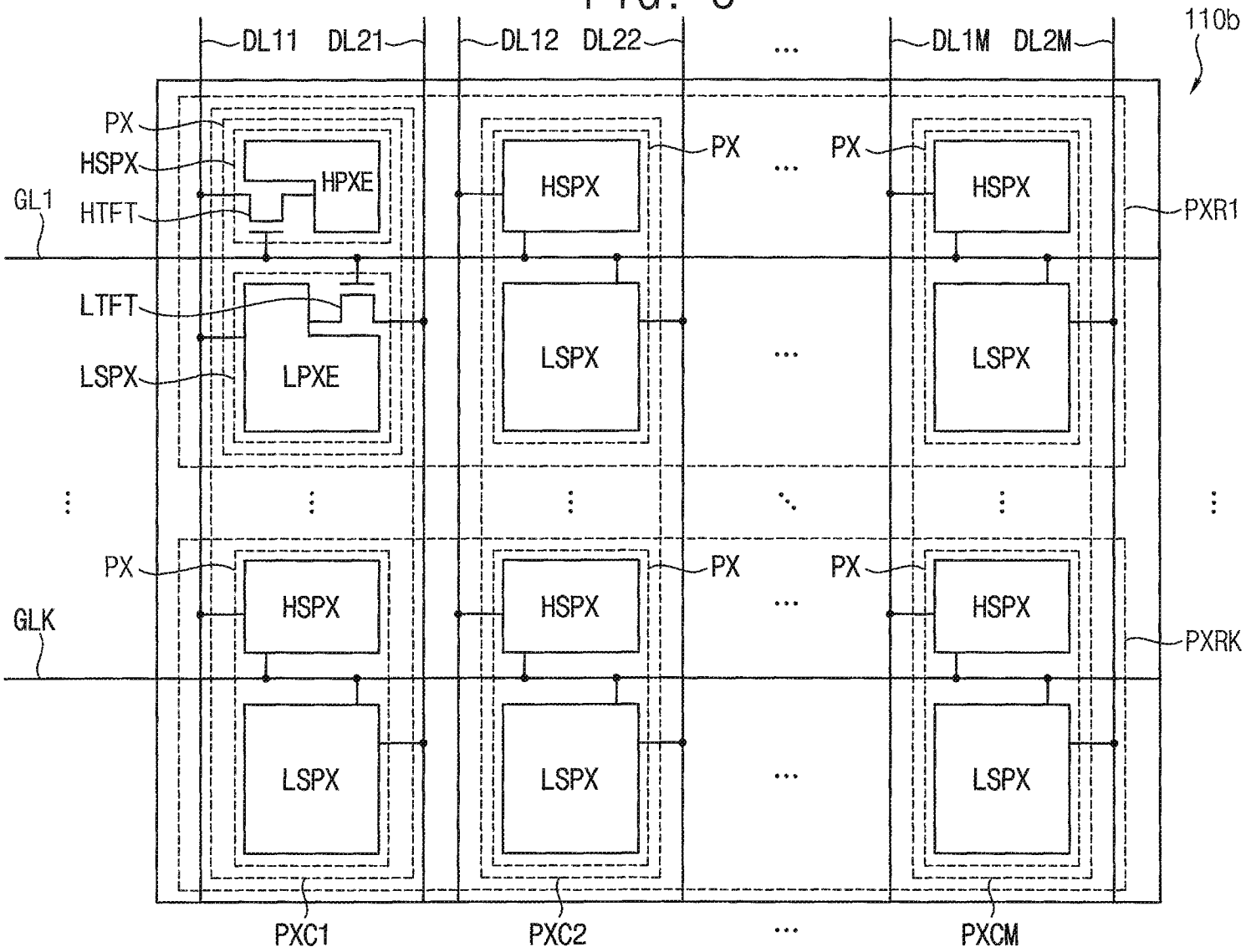
FIG. 3 is a diagram illustrating another example of a display panel included in a display device according to example embodiments.
Figure 4:
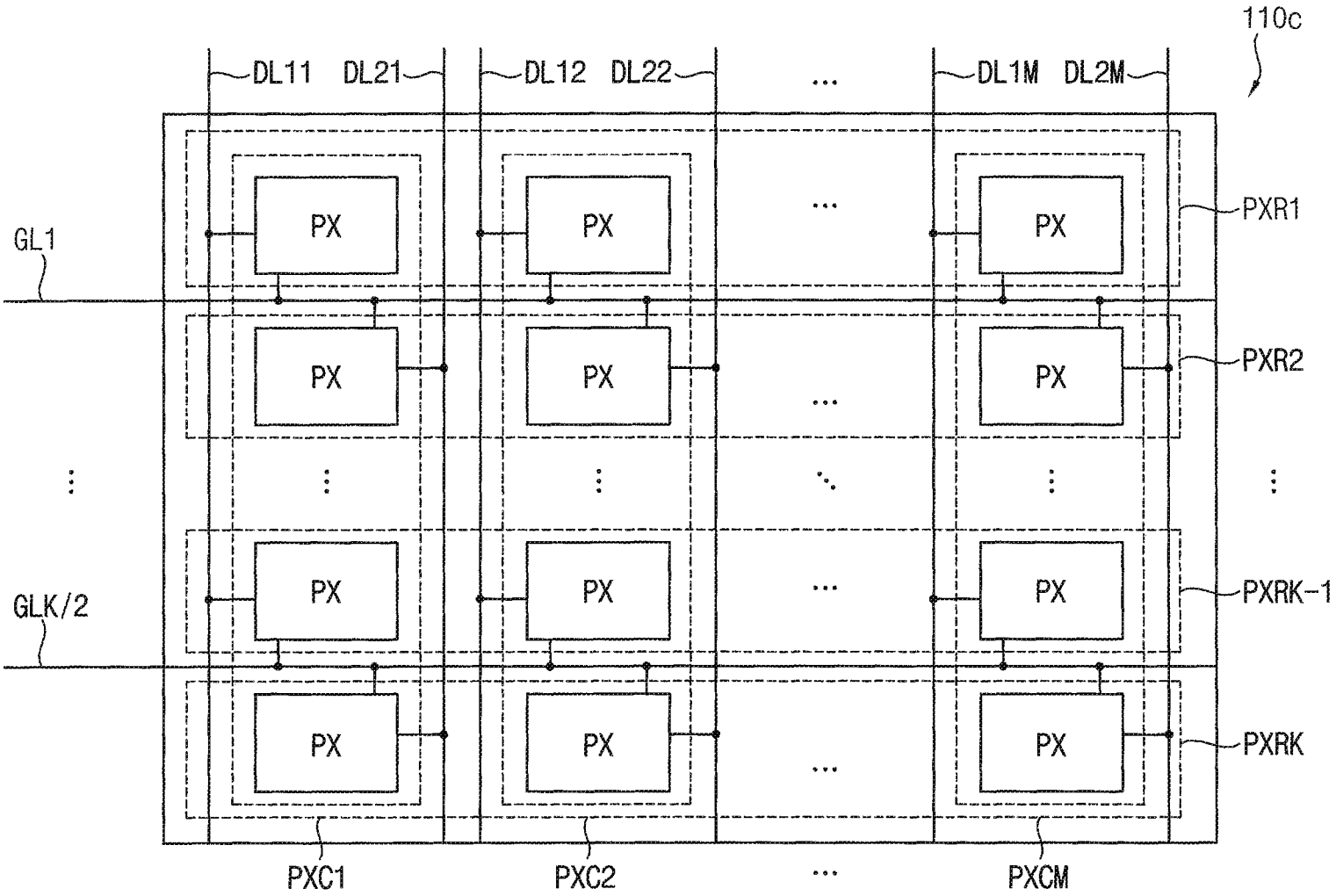
FIG. 4 is a diagram illustrating still another example of a display panel included in a display device according to example embodiments.
Figure 5A:
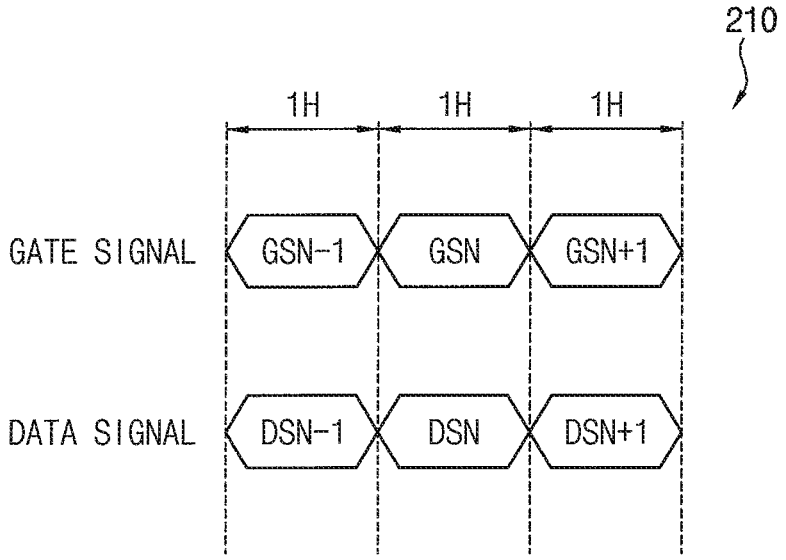
FIG. 5A (PRIOR ART)
FIG. 5A is a conventional timing diagram for describing an example of gate signals and data signals output at a gate driver and a data driver and FIG. 5B is a timing diagram for describing an example of gate signals and data signals output at a gate driver and a data driver included in a display device according to example embodiments.
Figure 5B:
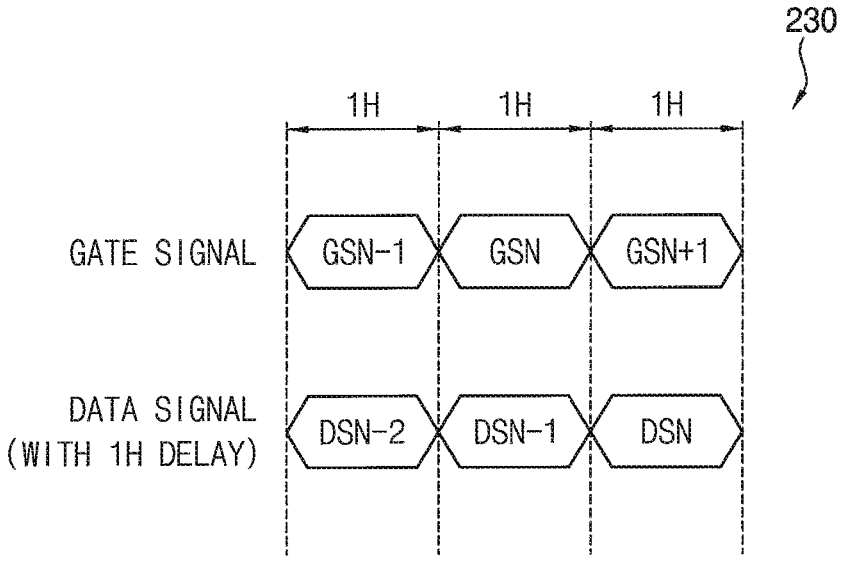
Figure 6A:
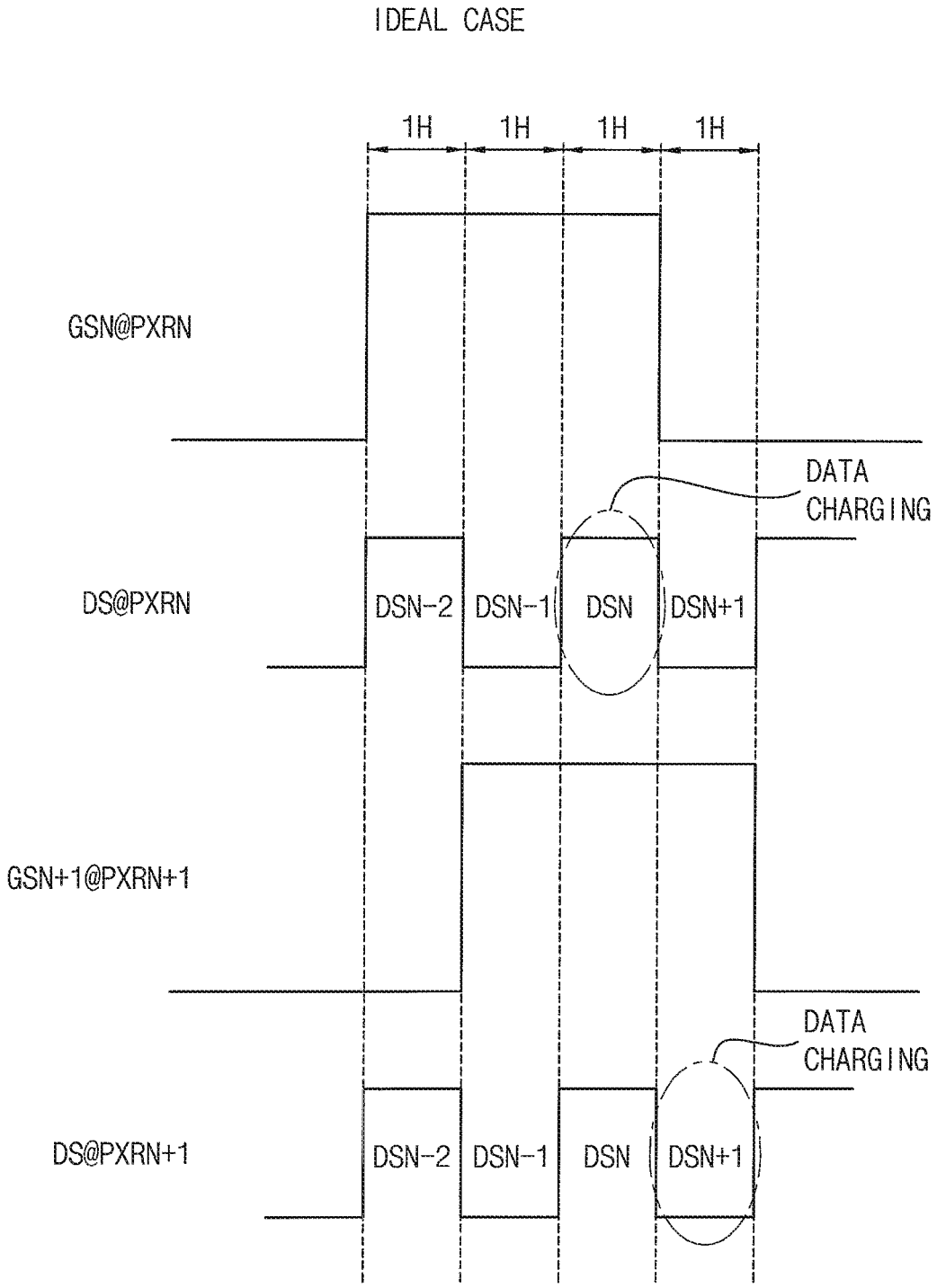
FIG. 6A (PRIOR ART)
FIG. 6A is a diagram illustrating gate signals and data signals applied to N-th and (N+1)-th pixel rows in an ideal case.
Figure 6B:
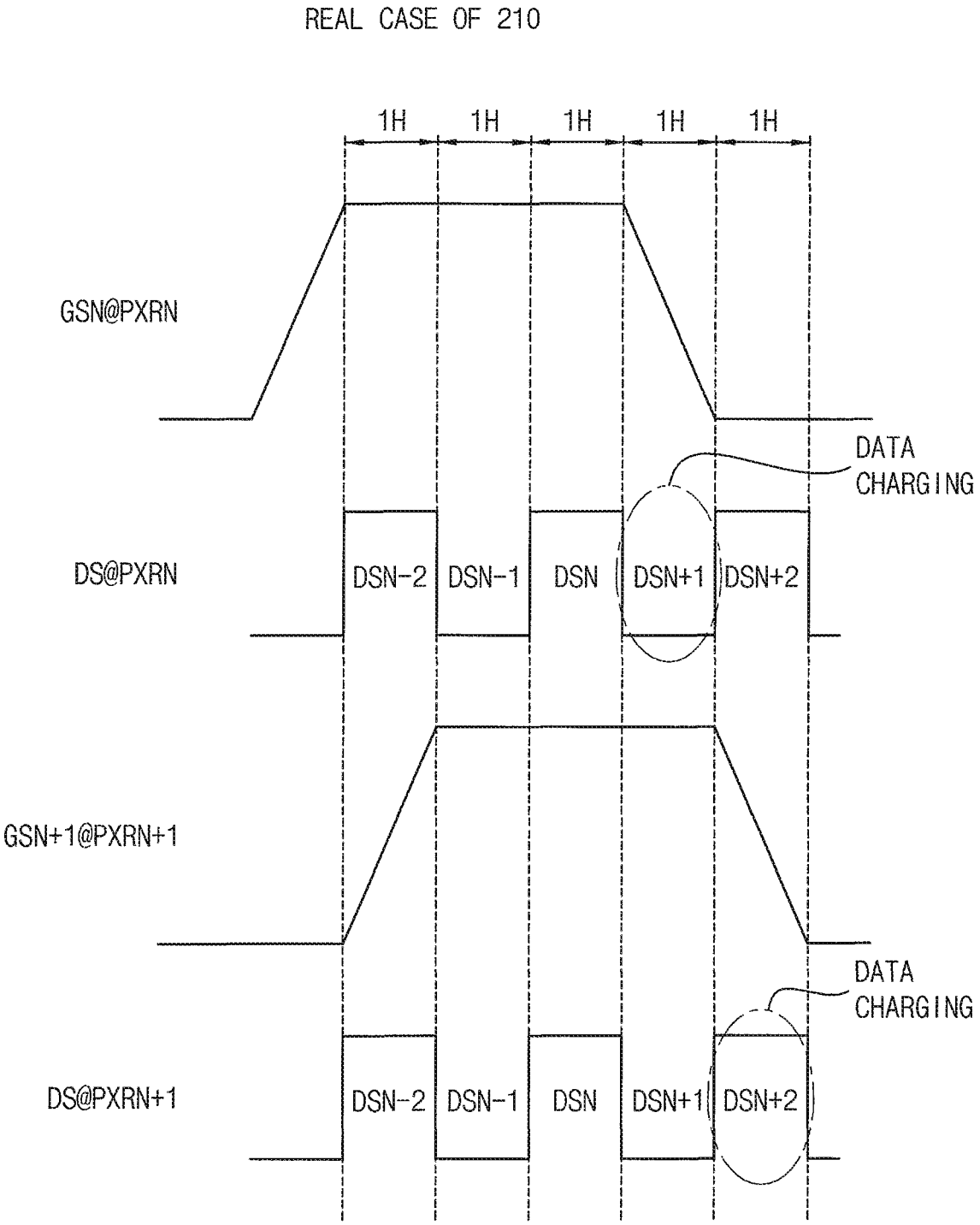
FIG. 6B (PRIOR ART)
FIG. 6B is a diagram illustrating gate signals and data signals applied to N-th and (N+1)-th pixel rows in a real case.
Figure 6C:
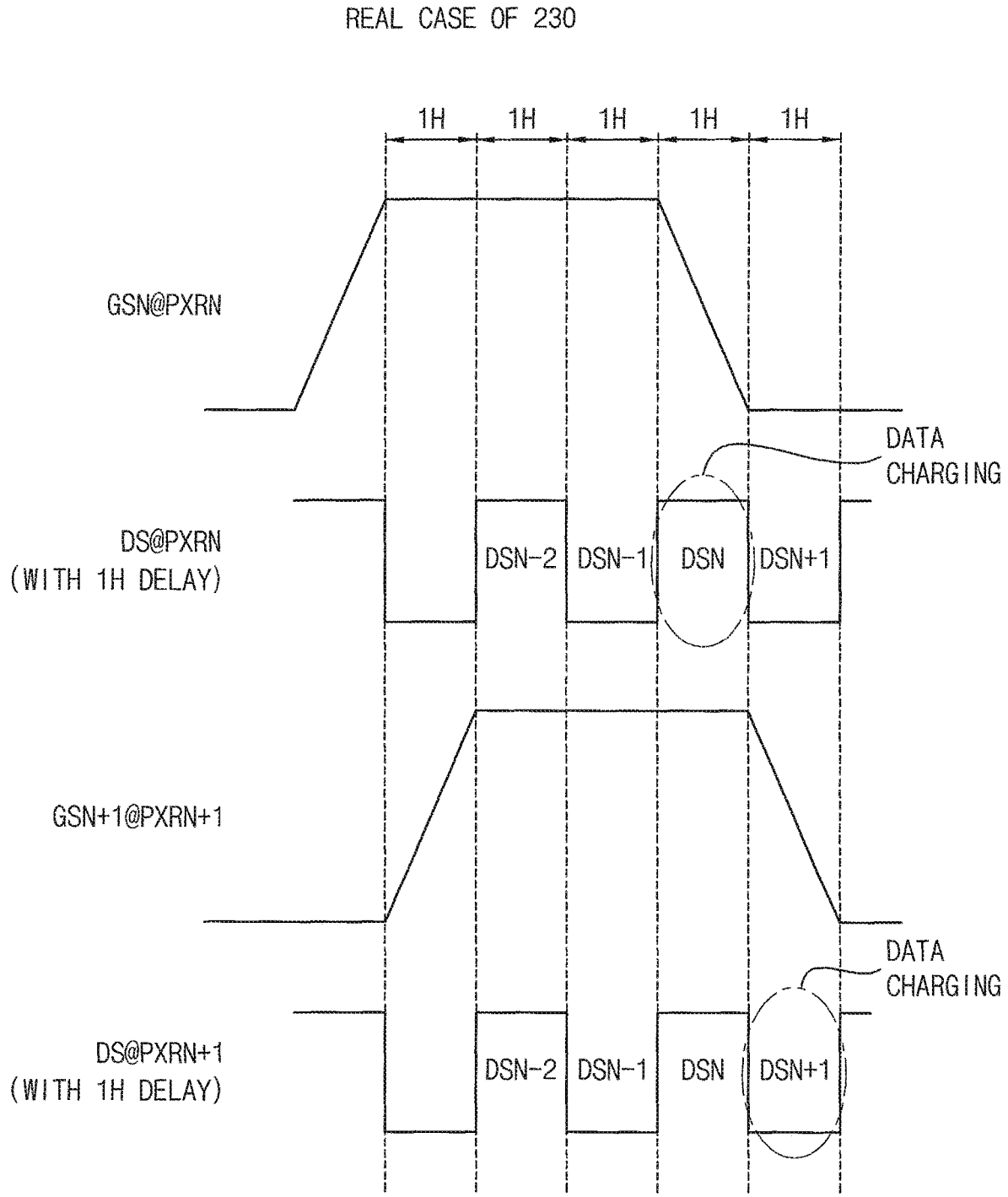
FIG. 6C is a diagram illustrating gate signals and data signals applied to N-th and (N+1)-th pixel rows in a real case according to example embodiments.

FIG. 1 is a block diagram illustrating a display device according to example embodiments, FIG. 2 is a diagram illustrating an example of a display panel included in a display device according to example embodiments, FIG. 3 is a diagram illustrating another example of a display panel included in a display device according to example embodiments, FIG. 4 is a diagram illustrating still another example of a display panel included in a display device according to example embodiments, FIG. 5 is a timing diagram for describing an example of gate signals and data signals output at a gate driver and a data driver included in a display device according to example embodiments, FIG. 6A is a diagram illustrating gate signals and data signals applied to N-th and (N+1)-th pixel rows in an ideal case, FIG. 6B is a diagram illustrating gate signals and data signals applied to N-th and (N+1)-th pixel rows in a real case, and FIG. 6C is a diagram illustrating gate signals and data signals applied to N-th and (N+1)-th pixel rows in a real case according to example embodiments.

Referring to FIG. 1, a display device 100 according to example embodiments may comprise a display panel 110 including a plurality of pixels PX, a gate driver 150 that provides a plurality of gate signals GS1, GS2, . . . , GSN, GSN+1, . . . , GSK to the plurality of pixels PX, a data driver 170 that provides data signals DS to the plurality of pixels PX, and a controller 130 that controls the gate driver 150 and the data driver 170.

The display panel 110 may include a plurality of gate lines GL1, GL2, . . . , GLN, GLN+1, . . . , GLK and a plurality of pixel rows PXR1, PXR2, . . . , PXRN, PXRN+1, . . . , PXRK. Each of the plurality of pixel rows PXR1, PXR2, . . . , PXRN, PXRN+1, . . . , PXRK may be coupled to a corresponding one of the plurality of gate lines GL1, GL2, . . . , GLN, GLN+1, . . . , GLK. The display panel 110 may further include a plurality of data lines crossing the plurality of gate lines GL1, GL2, . . . , GLN, GLN+1, . . . , GLK. In some example embodiments, each of the plurality of pixels PX in each pixel row PXR1, PXR2, . . . , PXRN, PXRN+1, . . . , PXRK may include a switching transistor and a liquid crystal capacitor coupled to the switching transistor, and the display panel 110 may be a liquid crystal display (LCD) panel.

In some example embodiments, as illustrated in FIG. 2, a display panel 110*a* may include K pixel rows PXR1, PXR2, . . . , PXRK and M pixel columns PXC1, PXC2, . . . , PXCM, where K is an integer greater than 1, and M is an integer greater than 1. Furthermore, the display panel 110*a* may have one gate one data (1G1D) structure where the number of the plurality of gate lines GL1, GL2, . . . , GLK corresponds to the number of the pixel rows PXR1, PXR2, . . . , PXRK, and the number of the plurality of data lines DL1, DL2, . . . , DLM corresponds to the number of the pixel columns PXC1, PXC2, . . . , PXCM. That is, the display panel 110*a* may further include K gate lines GL1, GL2, . . . , GLK and M data lines DL1, DL2, . . . , DLM. Thus, in the display panel 110*a*, the K pixel rows PXR1, PXR2, . . . , PXRK may be respectively coupled to the K gate lines GL1, GL2, . . . , GLK, and the M pixel columns PXC1, PXC2, . . . , PXCM may be respectively coupled to the M data lines DL1, DL2, . . . , DLM. Furthermore, each pixel PX of the display panel 110*a* may include, but not limited to, a pixel electrode PXE and a switching element TFT that transfers a data signal to the pixel electrode PXE in response to a gate signal.

In other example embodiments, as illustrated in FIG. 3, a display panel 110*b* may have one gate double data (1G2D) structure where the number of the plurality of gate lines GL1, GL2, . . . , GLK corresponds to the number of the pixel rows PXR1, PXR2, . . . , PXRK, and the number of the plurality of data lines DL11, DL12, . . . , DL1M, DL21, DL22, . . . , DL2M corresponds to twice the number of the pixel columns PXC1, PXC2, . . . , PXCM. That is, the display panel 110*b* may further include K gate lines GL1, GL2, . . . , GLK and 2 M data lines DL11, DL12, . . . , DL1M, DL21, DL22, . . . , DL2M. Thus, in the display panel 110*b*, the K pixel rows PXR1, PXR2, . . . , PXRK may be respectively coupled to the K gate lines GL1, GL2, . . . , GLK, and each pixel column (e.g., PXC1) of the M pixel columns PXC1, PXC2, . . . , PXCM may be coupled to corresponding two pixel columns (e.g., DL11 and DL21) of the 2 M data lines DL11, DL12, . . . , DL1M, DL21, DL22, . . . , DL2M. Furthermore, each pixel PX of the display panel 110*b* may include a high sub-pixel HSPX coupled to a first data line (e.g., DL11) of the 2 M data lines DL11, DL12, . . . , DL1M, DL21, DL22, . . . , DL2M, and a low sub-pixel LSPX coupled to a second data line (e.g., DL21) of the 2 M data lines DL11, DL12, . . . , DL1M, DL21, DL22, . . . , DL2M. For example, a high sub-pixel HSPX may include, but not limited to, a high pixel electrode HPXE and a high switching element HTFT that transfers a high data signal corresponding to a gray level for the pixel PX to the high pixel electrode HPXE in response to a gate signal, and the low sub-pixel LSPX disposed below the high sub-pixel HSPX may include, but not limited to, a low pixel electrode LPXE and a low switching element LTFT that transfers a low data signal corresponding to the same gray level for the pixel PX to the low pixel electrode LPXE in response to the gate signal. In some example embodiments, the high data signal provided through the first data line (e.g., DL11) may be, but not limited to, a data signal which is corresponding to a high gamma curve, and the low data signal provided through the second data line (e.g., DL21) may be, but not limited to, a data signal which is corresponding to a low gamma curve. In some example embodiments, a size of the high sub-pixel HSPX may be smaller than or equal to a size of the low sub-pixel LSPX. That is, a size of the high pixel electrode HPXE may be smaller than or equal to a size of the low pixel electrode LPXE. For example, a ratio of the size of the high sub-pixel HSPX, or the size of the high pixel electrode HPXE to the size of the low sub-pixel LSPX, or the size of the low pixel electrode LPXE may be about 1:2.

In other example embodiments, as illustrated in FIG. 4, a display panel 110*c* may have half gate double data (HG2D) structure where the number of the plurality of gate lines GL1, . . . , GLK/2 corresponds to half the number of the pixel rows PXR1, PXR2, . . . , PXRK, and the number of the plurality of data lines DL11, DL12, . . . , DL1M, DL21, DL22, . . . , DL2M corresponds to twice the number of the pixel columns PXC1, PXC2, . . . , PXCM. That is, the display panel 110*c* may further include K/2 gate lines GL1, . . . , GLK/2 and 2 M data lines DL11, DL12, . . . , DL1M, DL21, DL22, . . . , DL2M. Thus, in the display panel 110*c*, two adjacent ones (e.g., PXR1 and PXR2) of the K pixel rows PXR1, PXR2, . . . , PXRK may be respectively coupled to a corresponding one (e.g., GL1) of the K/2 gate lines GL1, . . . , GLK/2, and each pixel column (e.g., PXC1) of the M pixel columns PXC1, PXC2, . . . , PXCM may be coupled to corresponding two pixel columns (e.g., DL11 and DL21) of the 2 M data lines DL11, DL12, . . . , DL1M, DL21, DL22, . . . , DL2M.

Although FIGS. 2 through 4 illustrate examples of the display panels 110*a*, 110*b* and 110*c* having the 1G1D structure, the 1G2D structure and the HG2D structure respectively, the display panel 110 according to example embodiments may not be limited to the display panels 110*a*, 110*b* and 110*c* of FIGS. 2 through 4. In other example embodiments, the display panel 110 may be an organic light emitting diode (OLED) display panel where each pixel PX includes at least two transistors, at least one capacitor and an OLED. However, the display panel 110 may not be limited to the LCD panel and the OLED display panel, and may be any suitable display panel.

Referring back to FIG. 1, the controller (e.g., a timing controller (TCON)) 130 may receive input image data IDAT and a control signal CTRL from an external host (e.g., a graphic processing unit (GPU) or a graphic card). For example, the input image data IDAT may be, but not limited to, RGB image data including red image data, green image data and blue image data. Furthermore, for example, the control signal CTRL may include, but not be limited to, a vertical synchronization signal, a horizontal synchronization signal, an input data enable signal, and a master clock signal, etc. The controller 130 may generate output image data ODAT, a data control signal DCTRL, and a gate control signal GCTRL based on the input image data IDAT and the control signal CTRL. The controller 130 may control an operation of the gate driver 150 by providing the gate control signal GCTRL to the gate driver 150, and may control an operation of the data driver 170 by providing the output image data ODAT and the data control signal DCTRL to the data driver 170.

The gate driver 150 may generate the plurality of gate signals GS1, GS2, . . . , GSN, GSN+1, GSK based on the gate control signal GCTRL receiving from the controller 130, and may sequentially provide the plurality of gate signals GS1, GS2, GSN, GSN+1, . . . , GSK to the plurality of pixel rows PXR1, PXR2, . . . , PXRN, PXRN+1, . . . , PXRK through the plurality of gate lines GL1, GL2, . . . , GLN, GLN+1, . . . , GLK. In some example embodiments, the gate control signal GCTRL may include, but not limited to, a gate start signal STV indicating a start of a scan operation of the gate driver 150, and a gate clock signal. In some example embodiments, the gate driver 150 may be implemented as an amorphous silicon gate (ASG) driver integrated in a peripheral portion of the display panel 110. In other example embodiments, the gate driver 150 may be implemented with one or more gate driver integrated circuits (ICs). For example, the one or more gate driver ICs may be coupled to the display panel 110 in a chip on film (COF) process, or may be mounted directly on the display panel 110 in a chip on glass (COG) process.

The data driver 170 may generate the data signals DS based on the output image data ODAT and the data control signal DCTRL output from the controller 130, and may provide the data signals DS to each of the plurality of pixel rows PXR1, PXR2, . . . , PXRN, PXRN+1, . . . , PXRK. In some example embodiments, the data control signal DCTRL may include, but not limited to, a data enable signal DE indicating that the output image data ODAT are provided and a load signal. In some example embodiments, the data driver 170 may be implemented with one or more data driver ICs. For example, the one or more data driver ICs may be coupled to the display panel 110 in the COF process, or may be mounted directly on the display panel 110 in the COG process.

In the display device 100 according to example embodiments, the plurality of gate lines GL1, GL2, . . . , GLN, GLN+1, . . . , GLK may be designed to have a desired (or predetermined) gate delay time. For example, in designing the display device 100, a width of each gate line GL1, GL2, . . . , GLN, GLN+1, . . . , GLK may be adjusted such that the plurality of gate lines GL1, GL2, . . . , GLN, GLN+1, . . . , GLK has the desired (or predetermined) gate delay time. In some example embodiments, the desired gate delay time may correspond to one horizontal (1H) time. For example, in a case where the display panel 110 has a quad ultra high definition (QUHD) resolution (e.g., a 8 K resolution), or about 7680*4320 resolution, and the display device 100 is driven at a frame rate of about 120 Hz, the one horizontal (1H) time may be about 1.8 μs or about 1.9 μs. In this case, the plurality of gate lines GL1, GL2, . . . , GLN, GLN+1, . . . , GLK may be designed such that a width of each gate line decreases in a first case where an initial gate delay time (e.g., a gate delay time before designing the plurality of gate lines GL1, GL2, . . . , GLN, GLN+1, . . . , GLK is completed) of the gate line is shorter than the one horizontal (1H) time of about 1.8 μs or about 1.9 μs, and increases in a second case where the initial gate delay time of the gate line is longer than the one horizontal (1H) time of about 1.8 μs or about 1.9 μs. Accordingly, the plurality of gate lines GL1, GL2, . . . , GLN, GLN+1, . . . , GLK may have the desired (or predetermined) gate delay time of about 1.8 μs or about 1.9 μs.

Furthermore, in the display device 100, the controller 130 may control the gate driver 150 in order to sequentially output the plurality of gate signals GS1, GS2, . . . , GSN, GSN+1, . . . , GSK, and may control the data driver 170 to delay the data signals DS by the desired gate delay time of the plurality of gate lines GL1, GL2, . . . , GLN, GLN+1, . . . , GLK and to output the delayed data signals DS. In some example embodiments, the controller 130 may delay the data enable signal DE and the output image data ODAT provided to the data driver 170 by the desired gate delay time such that the data driver 170 outputs the data signals DS that are delayed by the desired gate delay time.

In a conventional display device, as illustrated as 210 in FIG. 5A, (N−1)-th data signals DSN−1 for an (N−1)-th pixel row may be output while an (N−1)-th gate signal GSN−1 for the (N−1)-th pixel row is output, N-th data signals DSN for an N-th pixel row PXRN may be output while an N-th gate signal GSN for the N-th pixel row PXRN is output, and (N+1)-th data signals DSN+1 for an (N+1)-th pixel row PXRN+1 may be output while an (N+1)-th gate signal GSN+1 for the (N+1)-th pixel row PXRN+1 is output, where N is an integer greater than 1. FIG. 6A illustrates the N-th gate signal GSN@PXRN at the N-th pixel PXRN, the N-th data signals DS@PXRN at the N-th pixel row PXRN, the (N+1)-th gate signal GSN+1@PXRN+1 at the (N+1)-th pixel PXRN+1 and the (N+1)-th data signals DS@PXRN+1 at the (N+1)-th pixel row PXRN+1 in an ideal case where the conventional display device performs an operation illustrated as 210 in FIG. 5. The (N+1)-th gate signal GSN+1@PXRN+1 may be applied 1H time after the N-th gate signal GSN@PXRN is applied. Although FIG. 6A illustrates an example where each gate signal GSN@PXRN and GSN+1@PXRN+1 has an ON period corresponding to three horizontal (3H) times, and adjacent gate signals GSN@PXRN and GSN+1 @PXRN+1 partially overlap each other, in some example embodiments, each gate signal GSN@PXRN and GSN+1@PXRN+1 may have an ON period corresponding to one horizontal (1H) time, and adjacent gate signals GSN@PXRN and GSN+1@PXRN+1 may not overlap each other. (N−2)-th data signals DSN−2 for an (N−2)-th pixel row, the (N−1)-th data signals DSN−1 for the (N−1)-th pixel row, the N-th data signals DSN for the N-th pixel row PXRN and the (N+1)-th data signals DSN+1 for the (N+1)-th pixel row PXRN+1 may be sequentially applied at an interval of the one horizontal (1H) time. The data signals DS@PXRN applied to the N-th pixel row PXRN and the data signals DS@PXRN+1 applied to the (N+1)-th pixel row PXRN+1 may be substantially the same data signals. In the ideal case of FIG. 6A, the N-th data signals DSN for the N-th pixel row PXRN may be applied to the N-th pixel row PXRN during an effective time period of the N-th gate signal GSN@PXRN (e.g., during the last one horizontal (1H) time of a high period of the N-th gate signal GSN@PXRN), and the N-th pixel row PXRN may be charged by the N-th data signals DSN for the N-th pixel row PXRN to display an image. Further, the (N+1)-th data signals DSN+1 for the (N+1)-th pixel row PXRN+1 may be applied to the (N+1)-th pixel row PXRN+1 during an effective time period of the (N+1)-th gate signal GSN+1@PXRN+1 (e.g., during the last one horizontal (1H) time of a high period of the (N+1)-th gate signal GSN+1@PXRN+1), and the (N+1)-th pixel row PXRN+1 may be charged by the (N+1)-th data signals DSN+1 for the (N+1)-th pixel row PXRN+1 to display an image.

However, in a real case where the conventional display device performs the operation illustrated as 210 in FIG. 5A, as illustrated in FIG. 6B, the gate signals GSN@PXRN and GSN+1@PXRN+1 may be delayed by a gate delay time of the plurality of gate lines GL1, GL2, . . . , GLN, GLN+1, . . . , GLK. Further, as a resolution of the conventional display device increases, a time length of the one horizontal (1H) time may be decreased. For example, the gate delay time of the plurality of gate lines GL1, GL2, . . . , GLN, GLN+1, . . . , GLK may correspond to the one horizontal (1H) time. In this case, as illustrated in FIG. 6B, the (N+1)-th data signals DSN+1 for the (N+1)-th pixel row PXRN+1 may be applied to the N-th pixel row PXRN during the effective time period of the N-th gate signal GSN@PXRN for the N-th pixel row PXRN, and the N-th pixel row PXRN may be charged by the (N+1)-th data signals DSN+1 for the (N+1)-th pixel row PXRN+1 to display an image. Further, (N+2)-th data signals DSN+2 for (N+2)-th pixel row may be applied to the (N+1)-th pixel row PXRN+1 during the effective time period of the (N+1)-th gate signal GSN+1@PXRN+1 for the (N+1)-th pixel row PXRN+1, and the (N+1)-th pixel row PXRN+1 may be charged by the (N+2)-th data signals DSN+2 for the (N+2)-th pixel row to display an image. Accordingly, not desired data signals (e.g., DSN), but erroneous data signals (e.g., DSN+1) may be charged or stored in each pixel row (e.g., PXRN), and thus the conventional display device may not operate normally.

However, in the display device 100 according to example embodiments, as illustrated as 230 in FIG. 5B, the data signals DSN−2, DSN−1 and DSN may be delayed by the desired (or predetermined) gate delay time, for example by the one horizontal (1H) time, and the data driver 170 may output the delayed data signals DSN−2, DSN−1 and DSN. In some example embodiments, to delay the data signals DSN−2, DSN−1 and DSN by the one horizontal (1H) time, the controller 130 may delay the data enable signal DE and the output image data ODAT provided to the data driver 170 by the one horizontal (1H) time, and the data driver 170 may delay the data signals DSN−2, DSN−1 and DSN by the one horizontal (1H) time in response to the data enable signal DE and the output image data ODAT that are delayed by the one horizontal (1H) time. Thus, in the display device 100, the (N−2)-th data signals DSN−2 for the (N−2)-th pixel row may be output while the (N−1)-th gate signal for the (N−1)-th pixel row is output, the (N−1)-th data signals DSN−1 for the (N−1)-th pixel row may be output while the N-th gate signal GSN for the N-th pixel row PXRN is output, and the N-th data signals DSN for the N-th pixel row PXRN may be output while the (N+1)-th gate signal GSN+1 for the (N+1)-th pixel row PXRN+1 is output. Accordingly, in a real case where the display device 100 performs an operation illustrated as 230 in FIG. 5, as illustrated in FIG. 6C, the pixel rows PXRN and PXRN+1 may receive the gate signals GSN@PXRN and GSN+1@PXRN+1 that are delayed by the desired gate delay time, for example by the one horizontal (1H) time by the plurality of gate lines GL1, GL2, . . . , GLN, GLN+1, . . . , GLK, and may receive the data signals DS@PXRN and DS@PXRN+1 that are delayed by the desired gate delay time, for example by the one horizontal (1H) time. Thus, as illustrated in FIG. 6C, the N-th data signals DSN for the N-th pixel row PXRN may be applied to the N-th pixel row PXRN during the effective time period of the N-th gate signal GSN@PXRN for the N-th pixel row PXRN, and the N-th pixel row PXRN may be charged by the N-th data signals DSN for the N-th pixel row PXRN to display an image. Further, the (N+1)-th data signals DSN+1 for the (N+1)-th pixel row PXRN+1 may be applied to the (N+1)-th pixel row PXRN+1 during the effective time period of the (N+1)-th gate signal GSN+1@PXRN+1 for the (N+1)-th pixel row PXRN+1, and the (N+1)-th pixel row PXRN+1 may be charged by the (N+1)-th data signals DSN+1 for the (N+1)-th pixel row PXRN+1 to display an image. Accordingly, in the display device 100 according to example embodiments, desired data signals (e.g., DSN) may be charged or stored in each pixel row (e.g., PXRN), and thus the display device 100 may operate normally.

As described above, in the display device 100 according to example embodiments, the plurality of gate lines GL1, GL2, . . . , GLN, GLN+1, . . . , GLK may be designed to have the desired (or predetermined) gate delay time, and the data driver 170 may delay the data signals DS by the desired gate delay time of the plurality of gate lines GL1, GL2, . . . , GLN, GLN+1, . . . , GLK to output the delayed data signals DS. Accordingly, when the display device 100 has a high resolution, the desired data signals (e.g., DSN) may be charged or stored in each pixel row (e.g., PXRN), and the display device 100 may operate normally.

Figure 7:
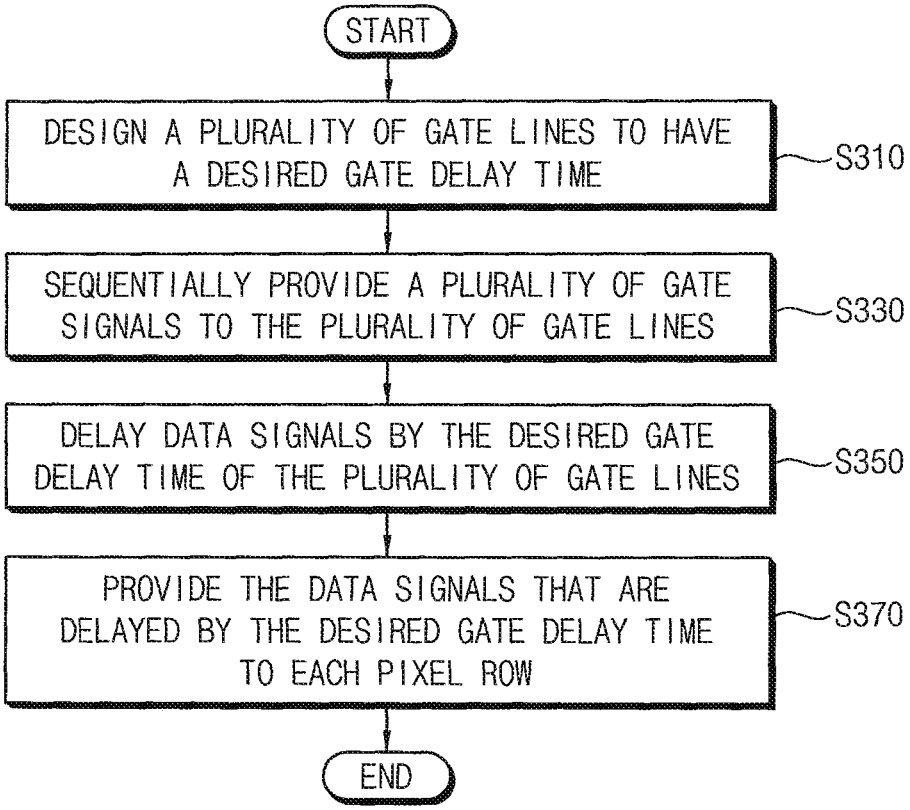
FIG. 7 is a flowchart illustrating a method of operating a display device according to example embodiments.
Figure 8:
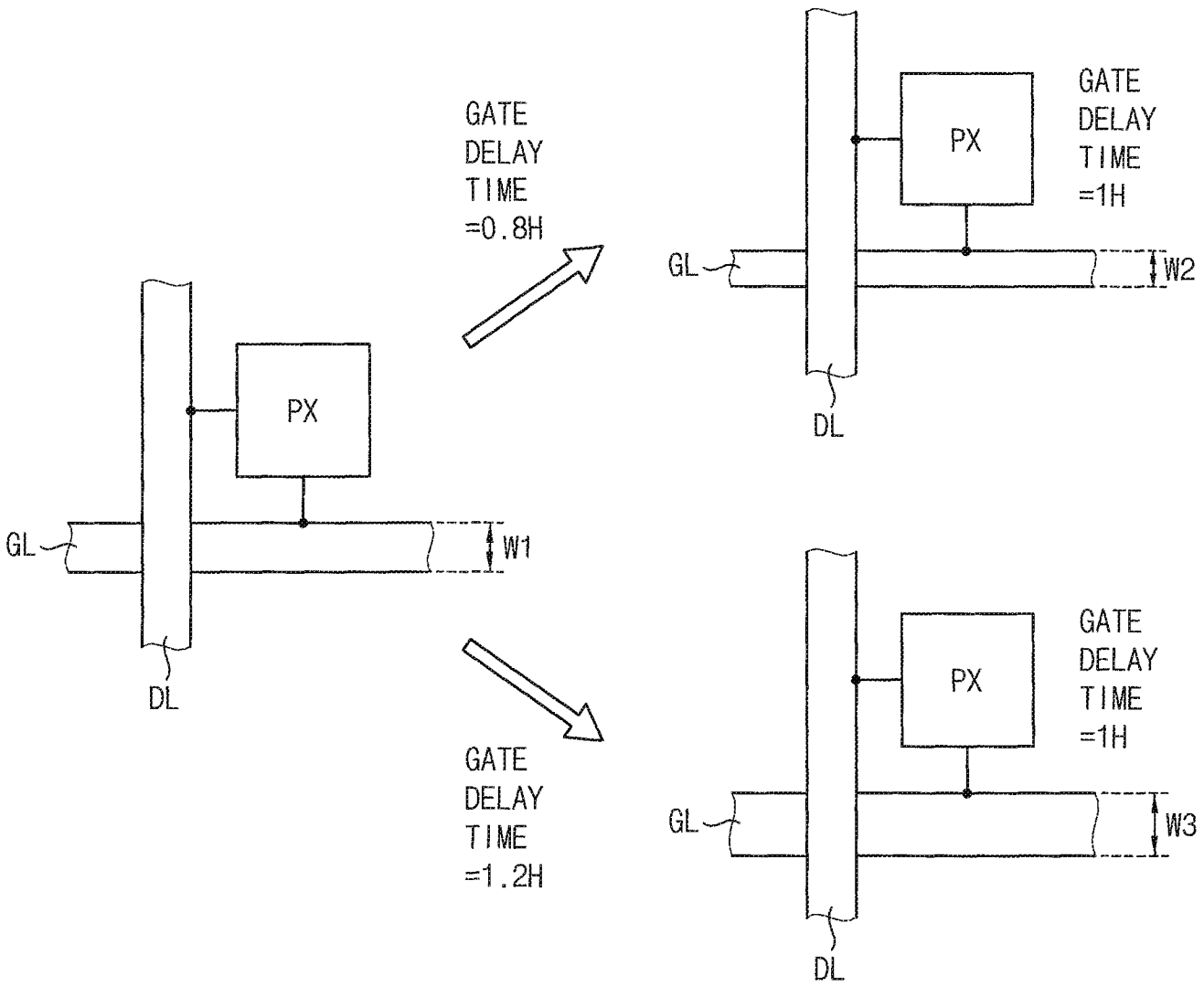
FIG. 8 is a diagram for describing an example where each gate line is designed to have a desired (or predetermined) gate delay time.
Figure 9:
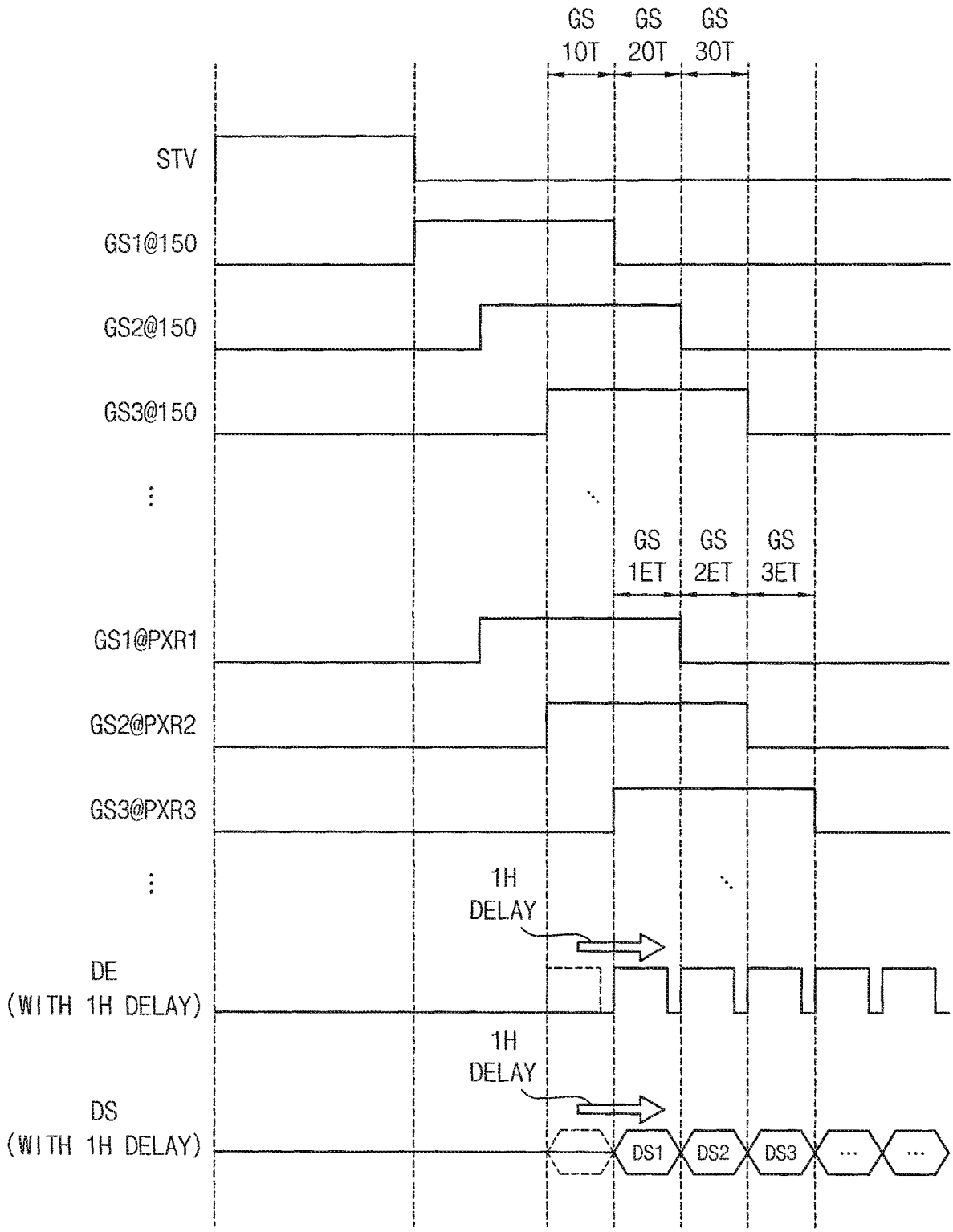
FIG. 9 is a timing diagram for describing an example of gate signals and data signals in a method of operating a display device according to example embodiments.

FIG. 7 is a flowchart illustrating a method of operating a display device according to example embodiments, FIG. 8 is a diagram for describing an example where each gate line is designed to have a desired (or predetermined) gate delay time, and FIG. 9 is a timing diagram for describing an example of gate signals and data signals in a method of operating a display device according to example embodiments.

Referring to FIGS. 1 and 7, when a display device 100 according to example embodiments is manufactured, a plurality of gate lines GL1, GL2, . . . , GLN, GLN+1, . . . , GLK may be designed to have a desired (or predetermined) gate delay time (S310). In some example embodiments, the plurality of gate lines GL1, GL2, . . . , GLN, GLN+1, . . . , GLK may be designed such that the plurality of gate lines GL1, GL2, . . . , GLN, GLN+1, . . . , GLK has the desired gate delay time corresponding to one horizontal (1H) time. For example, as illustrated in FIG. 8, in a case where an initial gate delay time (e.g., a gate delay time before designing the plurality of gate lines GL1, GL2, . . . , GLN, GLN+1, . . . , GLK is completed) of each gate line GL is shorter than the one horizontal (1H) time, or in a case where the initial gate delay time is about 0.8 horizontal (0.8 H) time, the gate line GL may be designed such that a width of the gate line GL decreases from a first width W1 to a second width W2. Once the display device 100 including the gate line GL having the second width W2 is manufactured, the gate line GL having the second width W2 may have the desired gate delay time of the one horizontal (1H) time. Furthermore, in a case where the initial gate delay time of each gate line GL is longer than the one horizontal (1H) time, or in a case where the initial gate delay time is about 1.2 horizontal (1.2 H) time, the gate line GL may be designed such that the width of the gate line GL is increased from the first width W1 to a third width W3. Once the display device 100 including the gate line GL having the third width W3 is manufactured, the gate line GL having the third width W3 may have the desired gate delay time of the one horizontal (1H) time.

When the display device 100 including a display panel 100 that includes the plurality of gate lines GL1, GL2, . . . , GLN, GLN+1, . . . , GLK designed to have the desired gate delay time, and a plurality of pixel rows PXR1, PXR2, . . . , PXRN, PXRN+1, . . . , PXRK of which is respectively coupled to a corresponding one of the plurality of gate lines GL1, GL2, . . . , GLN, GLN+1, . . . , GLK, a gate driver 150 may sequentially provide a plurality of gate signals GS1, GS2, . . . , GSN, GSN+1, . . . , GSK to the plurality of gate lines GL1, GL2, . . . , GLN, GLN+1, . . . , GLK (S330). Furthermore, a data driver 170 may delay data signals DS by the desired gate delay time of the plurality of gate lines GL1, GL2, . . . , GLN, GLN+1, . . . , GLK (S350), and may provide the data signals DS that are delayed by the desired gate delay time to each of the plurality of pixel rows PXR1, PXR2, . . . , PXRN, PXRN+1, . . . , PXRK (S370). In some example embodiments, a data enable signal DE and output image data ODAT provided to the data driver 170 are delayed by the desired gate delay time such that the data driver 170 outputs the data signals DS that are delayed by the desired gate delay time.

For example, as illustrated in FIG. 9, the gate driver 150 may sequentially output the plurality of gate signals GS1@150, GS2@150, GS3 @150, . . . with at an interval of one horizontal (1H) time in response to a gate start signal STV and a gate clock signal received from a controller 130. The plurality of gate signals GS1@150, GS2@150, GS3@150, . . . output at the gate driver 150 may be delayed by the desired gate delay time of the plurality of gate lines GL1, GL2, . . . , GLN, GLN+1, . . . , GLK, and the plurality of pixel rows PXR1, PXR2, PXR3, . . . may receive the plurality of gate signals GS1@PXR1, GS2@PXR2, GS3@PXR3 that are delayed by the desired gate delay time. In some example embodiments, the desired gate delay time may correspond to the 1H time. In this case, as illustrated in FIG. 9, a first effective time period GS1ET in which a first gate signal GS1@PXR1 is applied to a first pixel row PXR1 may be delayed or shifted by the one horizontal (1H) time compared with a first output time period GS1OT in which the first gate signal GS1@150 for the first pixel row PXR1 is output at the gate driver 150, a second effective time period GS2ET in which a second gate signal GS2@PXR2 is applied to a second pixel row PXR2 may be delayed or shifted by the one horizontal (1H) time compared with a second output time period GS2OT in which the second gate signal GS2@150 for the second pixel row PXR2 is output at the gate driver 150, and a third effective time period GS3ET in which a third gate signal GS3 @PXR3 is applied to a third pixel row PXR3 may be delayed or shifted by the 1H time compared with a third output time period GS3OT in which the third gate signal GS3@150 for the third pixel row PXR3 is output at the gate driver 150.

The controller 130 may provide the data driver 170 with the data enable signal DE and the output image data ODAT that are delayed by the desired gate delay time, or the one horizontal (1H) time, and the data driver 170 may provide each of the plurality of pixel rows PXR1, PXR2, PXR3, . . . with the data signals DS that are delayed by the one horizontal (1H) time in response to the data enable signal DE and the output image data ODAT that are delayed by the one horizontal (1H) time. Accordingly, when the effective time period GS1ET, GS2ET and GS3ET of each gate signal GS1@PXR1, GS2@PXR2 and GS3@PXR3 is delayed or shifted by the 1H time compared with the output time period GS1OT, GS2OT and GS3OT at the gate driver 150, desired data signals DS may be charged or stored in each pixel row PXR1, PXR2, PXR3. For example, the data signals DS1 for the first pixel row PXR1 may be charged or stored in the first pixel row PXR1 during the first effective time period GS1ET, the data signals DS2 for the second pixel row PXR2 may be charged or stored in the second pixel row PXR2 during the second effective time period GS2ET, and the data signals DS3 for the third pixel row PXR3 may be charged or stored in the third pixel row PXR3 during the third effective time period GS3ET.

As described above, in the method of operating the display device 100 according to example embodiments, the plurality of gate lines GL1, GL2, . . . , GLN, GLN+1, . . . , GLK may be designed to have the desired (or predetermined) gate delay time, and the data driver 170 may delay the data signals DS by the desired gate delay time of the plurality of gate lines GL1, GL2, . . . , GLN, GLN+1, . . . , GLK to output the delayed data signals DS. Accordingly, when the display device 100 has a high resolution, the desired data signals (e.g., DS1) may be charged or stored in each pixel row (e.g., PXR1), and the display device 100 may operate normally.

Figure 10:
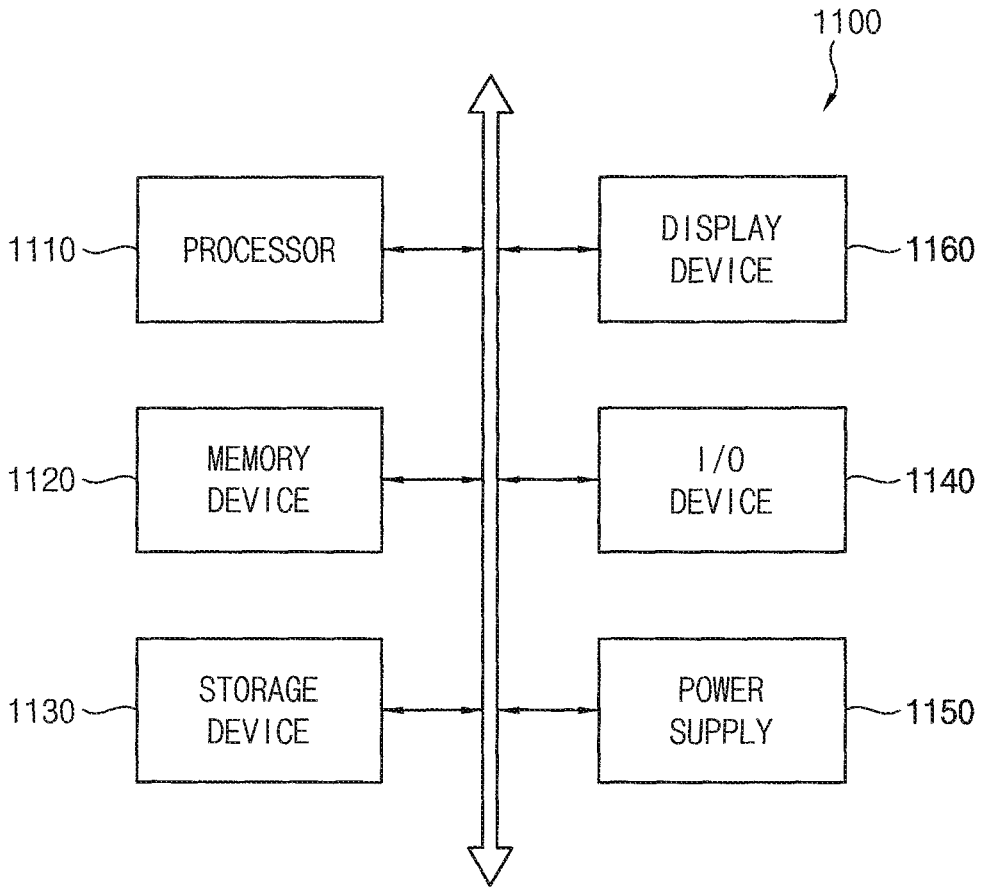
FIG. 10 is a block diagram illustrating an electronic device including a display device according to example embodiments.

FIG. 10 is a block diagram illustrating an electronic device including a display device according to example embodiments.

Referring to FIG. 10, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, and other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, and a data bus, etc. Furthermore, in some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In the display device 1160, a plurality of gate lines may be designed to have a desired (or predetermined) gate delay time (e.g., one horizontal (1H) time), and a data driver may delay data signals by the desired gate delay time of the plurality of gate lines to output the delayed data signals. Accordingly, when the display device 1160 has a high resolution, the desired data signals may be charged or stored in each pixel row, and the display device 1160 may operate normally.

The present disclosure may be applied to any display device 1160, and any electronic device 1100 including the display device 1160. For example, the present disclosure may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, and a navigation device, etc.

The foregoing is illustrative of example embodiments and is not to be construed as limiting. Although a few example embodiments have been described, those skilled in the art will readily appreciate that many modifications are possible in the example embodiments without materially departing from the novel teachings and advantages of the present disclosure. Accordingly, all such modifications are intended to be included within the scope of the present disclosure as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising: a display panel including a plurality of gate lines having a desired gate delay time, and a plurality of pixel rows, each of the plurality of pixel rows coupled to a corresponding one of the plurality of gate lines;

a gate driver configured to sequentially provide a plurality of gate signals to the plurality of gate lines; a data driver configured to provide data signals to each of the plurality of pixel rows; and a controller configured to control the gate driver in order to sequentially output the plurality of gate signals, and to control the data driver to output the data signals that are delayed by the desired gate delay time of the plurality of gate lines, wherein the plurality of gate lines is designed such that a width of each gate line decreases in a first case where an initial gate delay time of the gate line is shorter than one horizontal time and increases in a second case where the initial gate delay time of the gate line is longer than the one horizontal time.

2. The display device of claim 1, wherein the controller delays a data enable signal and output image data provided to the data driver by the desired gate delay time such that the data driver outputs the data signals that are delayed by the desired gate delay time.

3. The display device of claim 1, wherein the desired gate delay time corresponds to one horizontal time.

4. The display device of claim 3, wherein, in response to a data enable signal and output image data that are delayed by the one horizontal time, the data driver outputs the data signals for an (N−1)-th pixel row of the plurality of pixel rows while the gate driver outputs a first one of the plurality of gate signals for an N-th pixel row of the plurality of pixel rows, and outputs the data signals for the N-th pixel row of the plurality of pixel rows while the gate driver outputs a second one of the plurality of gate signals for an (N+1)-th pixel row of the plurality of pixel rows, where N is an integer greater than 1.

5. The display device of claim 4, wherein, while the N-th pixel row receives the first one of the plurality of gate signals for the N-th pixel row, the N-th pixel row further receives the data signals for the N-th pixel row.

6. The display device of claim 1, wherein the plurality of gate lines is designed to have the desired gate delay time corresponding to one horizontal time.

7. The display device of claim 1, wherein a number of the plurality of gate lines corresponds to a number of the plurality of pixel rows, and wherein the display panel further includes a plurality of data lines, and a number of the plurality of data lines corresponds to a number of a plurality of pixel columns of the display panel.

8. The display device of claim 1, wherein a number of the plurality of gate lines corresponds to a number of the plurality of pixel rows, and wherein the display panel further includes a plurality of data lines, and a number of the plurality of data lines corresponds to twice a number of a plurality of pixel columns of the display panel.

9. The display device of claim 8, wherein each pixel of the display panel includes a high sub-pixel coupled to a first data line of the plurality of data lines, and a low sub-pixel coupled to a second data line of the plurality of data lines.

10. The display device of claim 1, wherein a number of the plurality of gate lines corresponds to a half number of the plurality of pixel rows, and wherein the display panel further includes a plurality of data lines, and a number of the plurality of data lines corresponds to a twice number of a plurality of pixel columns of the display panel.

11. The display device of claim 1, wherein the display panel has a quad ultra high definition (QUHD) resolution.

12. A method of operating a display device including a display panel, the display panel including a plurality of gate lines and a plurality of pixel rows, each of the plurality of pixel rows coupled to a corresponding one of the plurality of gate lines, the method comprising: designing the plurality of gate lines to have a desired gate delay time; sequentially providing a plurality of gate signals to the plurality of gate lines; delaying data signals by the desired gate delay time of the plurality of gate lines; and providing the data signals that are delayed by the desired gate delay time to each of the plurality of pixel rows, wherein the designing the plurality of gate lines includes: designing the plurality of gate lines such that a width of each gate line decreases in a first case where an initial gate delay time of the gate line is shorter than one horizontal time; and designing the plurality of gate lines such that the width of the gate line increases in a second case where the initial gate delay time of the gate line is longer than the one horizontal time.

13. The method of claim 12, wherein a data enable signal and output image data provided to a data driver are delayed by the desired gate delay time such that the data driver outputs the data signals that are delayed by the desired gate delay time.

14. The method of claim 12, wherein the desired gate delay time corresponds to one horizontal time.

15. The method of claim 14, wherein the providing data signals that are delayed by the desired gate delay time to each of the plurality of pixel rows includes: outputting the data signals for an (N−1)-th pixel row of the plurality of pixel rows while a first one of the plurality of gate signals for an N-th pixel row of the plurality of pixel rows is output, where N is an integer greater than 1; and outputting the data signals for the N-th pixel row of the plurality of pixel rows while a second one of the plurality of gate signals for an (N+1)-th pixel row of the plurality of pixel rows is output.

16. The method of claim 15, wherein, while the N-th pixel row receives the first one of the plurality of gate signals for the N-th pixel row, the N-th pixel row further receives the data signals for the N-th pixel row.

17. The method of claim 12, wherein the designing the plurality of gate lines includes: designing the plurality of gate lines such that the plurality of gate lines has the desired gate delay time corresponding to one horizontal time.

18. The method of claim 12, wherein a number of the plurality of gate lines corresponds to a number of the plurality of pixel rows, and wherein the display panel further includes a plurality of data lines, and a number of the plurality of data lines corresponds to a number of a plurality of pixel columns of the display panel.

* * * * *